United States Patent [19]

Johnson

[11] 3,934,574

[45] Jan. 27, 1976

[54] HEAT EXCHANGER

[75] Inventor: Howard R. Johnson, Grass Lake, Mich.

[73] Assignee: Hush Company, Inc., Ann Arbor, Mich.

[22] Filed: Jan. 10, 1974

[21] Appl. No.: 432,199

[52] U.S. Cl. ..... 126/350; 122/338; 165/174; 431/114

[51] Int. Cl.[2] ..... F24H 1/00

[58] Field of Search ..... 126/350; 122/338; 165/154, 165/164, 174; 219/296, 298, 299, 302, 303, 304; 431/114

[56] References Cited

UNITED STATES PATENTS

| | | | |
|---|---|---|---|
| 1,101,872 | 6/1914 | Meacham | 122/155 C |
| 1,414,361 | 5/1922 | Hutchins et al. | 126/350 R |
| 2,558,971 | 7/1951 | Lundstrum | 126/350 R |
| 2,617,393 | 11/1952 | Peters | 126/350 R |
| 3,016,067 | 1/1962 | Edmonds | 165/174 |

FOREIGN PATENTS OR APPLICATIONS

| | | | |
|---|---|---|---|
| 141,165 | 1961 | U.S.S.R. | 165/174 |

*Primary Examiner*—Carroll B. Dority, Jr.
*Assistant Examiner*—Larry I. Schwartz
*Attorney, Agent, or Firm*—Beaman & Beaman

[57] ABSTRACT

A heat exchanger which includes a core of heat transmitting metal having a plurality of cylindrical passages directed therein. Heat supply means, such as a combustion chamber, is associated with the core and a heat transfer medium, such as water, is introduced into the passages in a spiral manner wherein the medium rotates within the passages to reduce boundary effects improving heat transfer characteristics. The heat exchange is characterized by its ability to efficiently transfer heat in a concise configuration.

9 Claims, 4 Drawing Figures

HEAT EXCHANGER

BACKGROUND OF THE INVENTION

The invention pertains to the field of tube type heat exchangers wherein a heat transfer medium passes through heat exchanger passages in a spiraling manner.

Tube type heat exchangers utilizing means for imparting a spiraling motion to a heat transfer medium, such as water, brine, or the like, are known. The advantage of imparting a spiraling motion to a heat transfer medium is to reduce the formation of heat insulation boundaries developing at the inner surface of the conduit or passage, and the rotation and turbulence of the medium assures high efficiency heat transfer between the medium and heat exchanger. However, known heat exchangers utilizing a spiraling medium flow produce such spiraling action by means of guides, vanes, restrictions and other apparatus which impedes the flow of the medium through the exchanger creating a resistance which must be overcome by employing relatively large pumps, complicated distribution apparatus and other equipment which increases the size of the heat exchanger and associated equipment.

While relatively small heat exchangers are known, such as hot water or steam boilers, such devices have not enjoyed high efficiencies with respect to heat transfer and high heat transfer efficiency heretofore has often been sacrificed in heat exchangers of a concise configuration. In this present age of fuel shortages low efficiency heat exchangers cannot be tolerated.

SUMMARY OF THE INVENTION

It is an object of the invention to provide a heat exchanger of a concise configuration which is capable of operating at high efficiencies of heat transfer.

Another object of the invention is to provide a concise heat exchanger through which a liquid heat transfer medium may flow wherein a minimum of resistance to flow is produced, yet high efficiencies are achieved by a spiraling movement of the liquid through core passages.

An additional object of the invention is to provide a heat exchanger utilizing a spiraling heat transfer medium flow through passages wherein the spiraling of the medium is accomplished without restrictions or impeding structure within the passages.

A further object of the invention is to provide a furnace embodiment of a heat exchanger constructed in accord with the invention wherein a wave trap and baffles are used in the combustion chamber to effectively transfer heat from the chamber to the exchanger core, and wherein a complete combustion is obtained very low in polluting emissions.

In the practice of the invention the heat exchanger includes an elongated core having a plurality of cylindrical passages defined therein. The passages have an inlet end and an outlet end, and the heat exchanging medium is introduced into the inlet end of the passages in a direction substantially tangential to the passages wherein the medium has a spiraling action within the passages creating a flow path and turbulence highly conducive to high efficiency heat transfer. No restrictions exist within the passages and the medium is also preferably ejected from the passages in a tangential manner to provide optimum flow characteristics.

The heat transfer medium is introduced into a chamber adjacent the inlet end of the passages and vanes within the chamber impart an initial spiraling action to the medium which further augments the spiraling action of the medium as it directly enters the heat exchanging passages. In the disclosed furnace embodiment a combustion chamber is disclosed as being centrally formed within the core, and wave trap and transfer means within the combustion chamber effectively transfers the heat therein directly to the core.

A heat exchanger in accord with the invention may be effectively used with combination heating and air conditioning units exteriorly located of the dwelling, and the efficiency of a heat exchanger in accord with the invention permits a furnace, for instance, to be concisely housed within a relatively small housing for location adjacent the space being heated.

BRIEF DESCRIPTION OF THE DRAWINGS

The aforementioned objects and advantages of the invention will be apparent from the following description and accompanying drawings wherein.

DESCRIPTION OF THE PREFERRED EMBODIMENT

Figure 1:
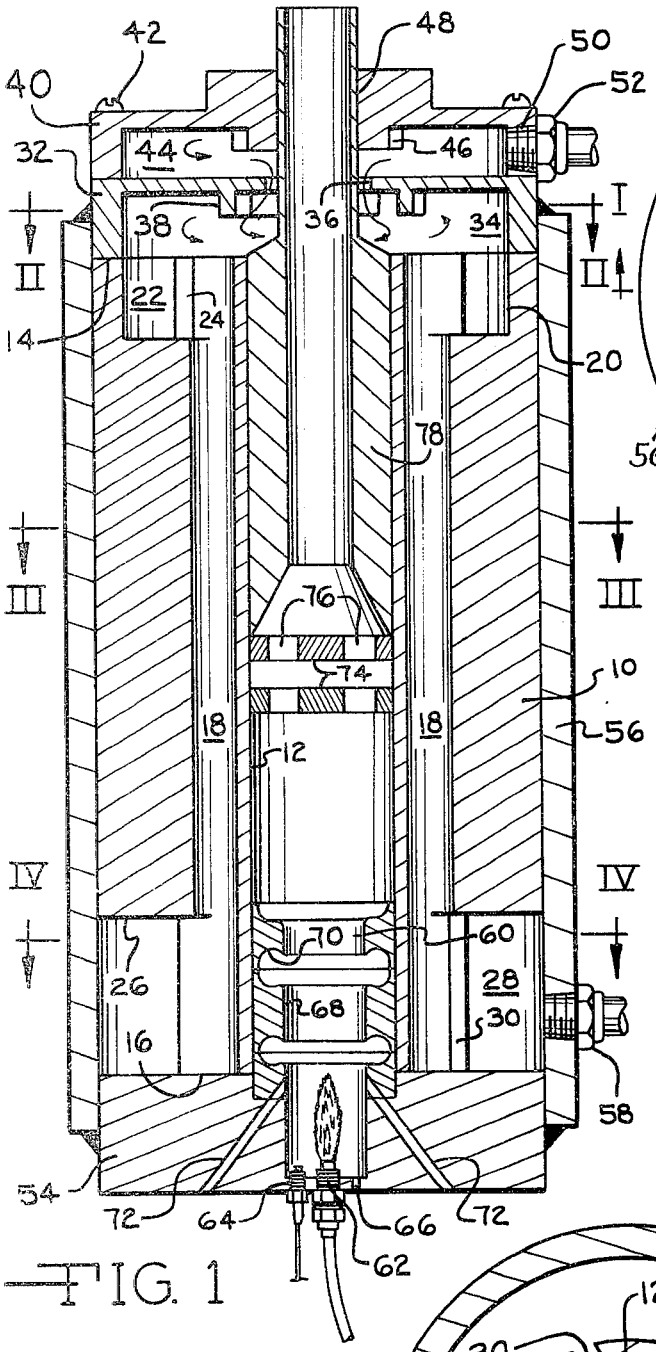
FIG. 1 is a diametrical, elevational, sectional view of a heat exchanger in accord with the invention as taken along section I—I of FIG. 2.

In the drawings the heat exchanger in accord with the invention is illustrated as a furnace, and the inventive concept is used to particular advantage in a furnace embodiment. However, it is to be appreciated that the principles and concept of the invention may also be used in other heat exchangers utilizing fluid heat transfer mediums. For instance, the core and passages of the invention could be used with refrigeration means to cool water or brine.

In the disclosed embodiment a typical relationship of components used to practice the invention as a furnace are disclosed, and it will be appreciated that the concepts of the invention may be employed in a wide variety of structural variations.

The disclosed heat exchanger includes a generally cylindrical core 10 formed of a material having high heat transfer characteristics, for instance, aluminum or copper. The core may be formed as an extrusion, for purposes of economical manufacture, or may be constructed of tubular stock in which the heat transfer medium passages are drilled.

The interior of the core 10 is provided with a longitudinally extending cylindrical bore 12 intersecting the core's upper end 14, and the lower end 16. A plurality of longitudinally extending heat transfer medium receiving passages 18 of a cylindrical configuration are concentrically spaced about the axis of the core and radially spaced relatively close to the bore 12. The upper end of the core is recessed at 20 to form an annular chamber 22, and the adjacent end regions of the passages 18 are intersected by tangentially disposed inlet ports 24 having an axial length equal to the depth of the chamber 22. The ports 24 are tangentially disposed to the associated passage 18, FIG. 2, and the ports of the passages are related in a common direction to the passages.

Figure 4:
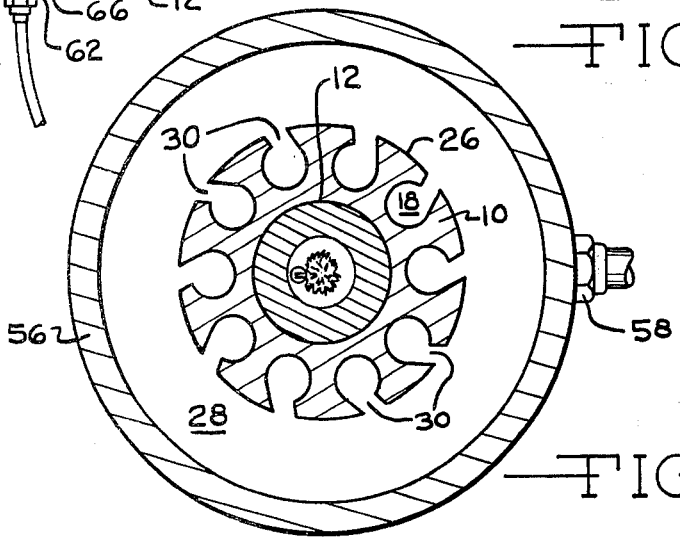
FIG. 4 is a plan, transverse, cross-sectional view as taken along section IV-IV of FIG. 1.

The lower end of the core is machined to a reduced diameter defining an annular recess 26 forming chamber 28. Throughout the axial length of the chamber 28 the core is machined to define tangential outlet ports 30, FIG. 4, which intersect the passages 18 and the chamber 28, and are disposed in a tangential direction with respect to its associated passage opposite in direction to the inlet port 24, FIG. 2.

Figure 2:
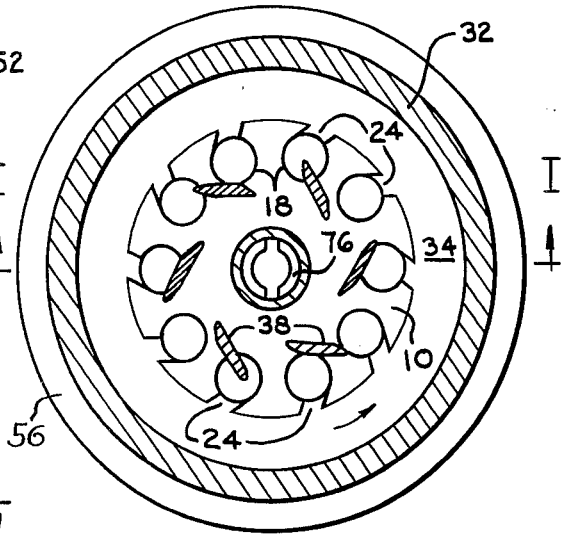
FIG. 2 is a plan, transverse, sectional view taken along section II—II of FIG. 1.

An inner head 32 is mounted to the upper end of the core and is of a dished configuration defining a cylindrical chamber 34 corresponding in diameter to the chamber 22 wherein these two chambers define a large inlet chamber. The inner head 32 is provided with a central opening 36, and a plurality of vanes 38, FIG. 2, are affixed to the head adjacent the opening 36 obliquely disposed outwardly in a direction similar to the tangential orientation of the inlet ports 24.

An outer head 40 is attached to the inner head 32 by screws 42 and the outer head also defines a circular chamber 44 and includes vanes 46 similar in configuration and orientation to the vanes 38. The outer head 40 is provided with a flue receiving opening 48, and a threaded hole 50 receives the heat exchanging medium inlet conduit fitting 52.

The lower end of the core is enclosed by lower head 54 engaging the core lower end 16. The lower head 54, and the inner head 32 are disclosed as being related to the core by a cylindrical casing 56 whose ends are welded to the inner head and lower head. The casing includes a heat transfer medium outlet fitting 58 communicating with the chamber 28.

The core 10 is heated by a combustion chamber generally indicated at 60. The combustion chamber apparatus includes a burner nozzle 62 mounted in the lower head 54 which will burn natural or liquified gas. The ignition of the fuel is accomplished by the electrical spark device 64, of conventional construction. Air ports 66 are defined in the head 54, and may be obliquely disposed wherein air entering the ports spirals within the combustion chamber about the nozzle to produce a turbulence for effectively transmitting heat to the core.

An axially extending wave trap 68 is located within the combustion chamber 60, and the wave trap is defined by stacked segments which form annular concave recesses 70. The wave trap 68 reduces the combustion noise and produces a turbulence of the heated gases by creating a spinning action within the recesses 70 which aids in transmitting heat to the core.

Air ports 72 are defined in the lower region of the wave trap and also extend through the lower head 54. The air ports 72 are obliquely disposed with respect to the axis of the combustion chamber to produce a swirling action within the combustion chamber, and the air passing through ports 66 augments this action.

Figure 3:
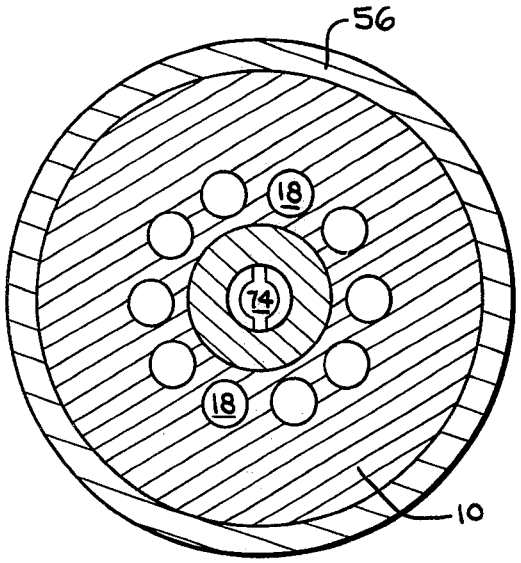
FIG. 3 is a plan, transverse, cross-sectional view as taken along section III-III of FIG. 1.

Additional turbulence of the heat gases, noise reduction and heat transfer is produced by the disks 74 mounted in the combustion chamber each including arcuate semicircular openings 76 as will be apparent from FIGS. 2 and 3. The disks 74 are in firm engagement with the walls of the core bore 12 and further aid in effectively transferring heat to the core.

The lower region of the flue 78 is of a diameter directly engaging the bore 12 so as to further effectively transfer heat to the core, and the upper portion of the flue of a reduced diameter to be closely received in a sealing relationship with the outer head central opening 48.

In operation, the heat transfer medium, such as water, or a solution of water and antifreeze, is forced into the chamber 44 through the fitting 52. The fitting 52 may be tangentially disposed to the chamber 44 to facilitate the spiraling action, but regardless of the fitting orientation, the presence of the vanes 46 will impart a counterclockwise rotation to the fluid medium as it flows through the central opening 36 adjacent the flue 78. The counterclockwise spiraling of the medium, FIG. 2, as it enters the chambers 22 and 34, is further augmented by the presence of the vanes 38, and thus it will be appreciated that the medium will be rotating in a counterclockwise direction within the chamber adjacent the inlet ports 24.

As the direction of the rotation of the heat transfer medium within the chamber 22 is in the direction most effectively received by the inlet ports 24 the fluid medium entering the passages 18 will have a high rotative force imposed thereon due to the orientation of the ports, and the direction of rotation of the medium as it enters the ports.

The medium flows downwardly through the passages 18 counterflow to the direction of heat passing upwardly through the combustion chamber 60 and flue 78. The fluid path of the medium through the passages is counterclockwise as viewed in FIGS. 2–4, and this strong spiraling effect eliminates any boundary layer within the passages adjacent the core and a most effective transfer of heat from the core to the medium takes place.

The fluid medium is discharged from the passages 18 through the outlet ports 30 into the annular lower chamber 28, and is removed from the heat exchanger through the outlet conduit fitting 58. As the outlet ports 30 are disposed in that tangential direction to most effectively discharge the fluid medium from the passages without creating a restriction or back pressure, the fluid flow through the passages adjacent the lower region of the core continues to be in a spiral manner and the medium is effectively discharged from the passages with little resistance.

The heat transfer fluid medium flow through the heat exchanger in accord with the invention occurs with little resistance as no restrictions exist within the passages 18. The spiraling motion of the fluid medium is accomplished solely by the tangential injection of the medium into the passages and thus restrictions such as produced by passage guides, vanes and other flow control devices commonly used within heat exchanging tubes are eliminated.

The core 10 functions as a direct heat sink as the core is in direct engagement with the combustion chamber and thus a high efficiency of heat exchanging is achieved. This fact, in conjunction with the spiraling action of the medium flowing through the passages, the high heat transfer characteristics of the core material, and the construction of the combustion chamber, wave traps and baffle discs, permit a furnace of approximately one foot in length to provide sufficient heat to heat a conventional sized dwelling. For instance, heat exchangers of this type may be mounted within combination heating and air conditioning housings exteriorly located of the dwelling wherein the heated heat transfer medium is pumped through finned heat exchangers located within the dwelling air circulation system. Also, it will be appreciated that this type of heat exchanger may directly function as a boiler in a hot water heating system.

If the heat exchanger in accord with the invention is located within a space to be heated, the casing 56 may be provided with fins on its exterior surface to increase surface area such that the casing itself may contribute to the ambient heating.

The concise configuration of the heat exchanger, and its quiet operation, permit this type of heat exchanger to be used at the place of need, rather than requiring long conduits or ductwork, and the elimination of a pilot light conserves fuel.

It is appreciated that variations in construction will be apparent to those skilled in the art without departing from the scope of the invention. For instance, pluralities of sets of passages 18 could be formed in the core 10, the combustion chamber 60 could be replaced by an expansion chamber of a refrigeration system if the heat exchanger was to be used for cooling, rather than heating, purposes. Further, the casing 56 could be eliminated by making slight modifications to the configuration of the core, wherein the core heads are directly attached to the core by head screws.

I claim:

1. A heat exchanger characterized by its high heat exchanging capabilities in a concise configuration comprising, in combination, an elongated heat conducting core having first and second end regions, a plurality of passages defined in said core extending between said end regions, said passages each having first and second end regions, respectively, heat exchanging supply means associated with said core controlling the temperature thereof, a first chamber communicating with said core first end region and said passages' first ends, a second chamber communicating with said core second end region and said passages' second ends, inlet fluid heat transfer means communicating with said first chamber, outlet fluid heat transfer means communicating with said second chamber, and fluid flow control means introducing a fluid heat transfer medium into said passages' first end in a spiraling manner to effectively transfer heat between said core and the medium within said passages, said fluid flow control means including elongated inlet ports defined in said core having a length parallel to the length of said core and communicating with said first chamber and intersecting said passages' first ends in a substantially tangential manner.

2. In a heat exchanger as in claim 1 wherein said heat exchanging supply means comprises a combustion chamber defined within said core, wave traps defined within said combustion chamber having annular recesses communicating with said combustion chamber, heat diffusion and transfer means within said combustion chamber in engagement with said core transferring heat from said combustion chamber to said core and a burner nozzle within said combustion chamber.

3. A heat exchanger characterized by its high heat exchanging capabilities in a concise configuration comprising, in combination, an elongated heat conducting core having first and second end regions, a plurality of passages defined in said core extending between said end regions, said passages each having first and second end regions, respectively, heat exchanging supply means associated with said core controlling the temperature thereof, a first chamber communicating with said core first end region and said passages' first ends, a second chamber communicating with said core second end region and said passages' second ends, inlet fluid heat transfer means communicating with said first chamber, outlet fluid heat transfer means communicating with said second chamber, and fluid flow control means introducing a fluid heat transfer medium into said passages' first end in a spiraling manner to effectively transfer heat between said core and the medium within said passages, said fluid flow control means including vanes defined in said first chamber imparting a rotating movement to heat transfer medium flowing into said first chamber from said inlet heat transfer means.

4. In a heat exchanger as in claim 3 wherein said first chamber includes first and second stage chambers, said inlet heat transfer means communicating with said first stage chamber, said first stage chamber communicating with said second stage chamber and fluid medium rotation imparting vanes defined in both stages of said first chamber.

5. A heat exchanger characterized by its high heat exchanging capabilities in a concise configuration comprising, in combination, a core of heat conducting material having a longitudinal axis, an inlet end and an outlet end, a longitudinal, axially extending combustion chamber centrally defined within said core, a burner nozzle within said combustion chamber, a plurality of longitudinally extending cylindrical passages defined in said core having inlet and outlet ends, a first chamber communicating with said core inlet end and communicating with said passages' inlet ends, a second chamber communicating with said core outlet end and communicating with said passages' outlet ends, an inlet conduit communicating with said first chamber, an outlet conduit communicating with said second chamber, and fluid flow control means within said first chamber imparting a rotative motion to fluid entering said passages' inlet ends whereby fluid passing through said passages moves in a spiraling manner therethrough.

6. In a heat exchanger as in claim 5 wherein said fluid flow control means include vanes defined in said first chamber imparting a rotating movement to fluid received from said inlet conduit.

7. In a heat exchanger as in claim 5 wherein said flow control means include axially extending ports defined in said passages' inlet ends communicating with said first chamber and substantially tangentially related to the associated passage.

8. In a heat exchanger as in claim 6 wherein said flow control means include axially extending ports defined in said passages' inlet ends communicating with said first chamber and substantially tangentially related to the associated passage.

9. In a heat exchanger as in claim 5 wherein said first chamber includes first and second stage chambers, said inlet conduit communicating with said first stage chamber, said first stage chamber communicating with said second stage chamber and rotation imparting vanes defined in both stages of said first chamber.

* * * * *